US005534984A

United States Patent [19]

Inoue

[11] Patent Number: 5,534,984

[45] Date of Patent: Jul. 9, 1996

[54] RECORDING APPARATUS HAVING A TRANSFER DRUM SHIFTING DEVICE

[75] Inventor: Hiroyuki Inoue, Kawasaki, Japan

[73] Assignee: Fujitsu Limited, Kawasaki, Japan

[21] Appl. No.: 393,680

[22] Filed: Feb. 24, 1995

[30] Foreign Application Priority Data

Mar. 2, 1994 [JP] Japan ..... 6-031718
Feb. 13, 1995 [JP] Japan ..... 7-024168

[51] Int. Cl.[6] ..... G03G 15/16

[52] U.S. Cl. ..... 355/271; 355/274

[58] Field of Search ..... 355/277, 299, 355/298, 208, 271

[56] References Cited

U.S. PATENT DOCUMENTS 5,237,374 8/1993 Ueno et al. ..... 355/299
5,374,982 12/1994 Boockholdt ..... 355/277

FOREIGN PATENT DOCUMENTS 56-164372 12/1981 Japan .

*Primary Examiner*—Joan H. Pendegrass
*Assistant Examiner*—Qvana Granger
*Attorney, Agent, or Firm*—Armstrong, Westerman, Hattori, McLeland & Naughton

[57] ABSTRACT

To provide a reasonable and economical recording apparatus wherein an inevitable fluctuation of an intermediate transfer drum or the like does not adversely influence other elements. A recording apparatus wherein a toner image on a photosensitive drum (11) is primarily transferred to an intermediate transfer drum (21) and the toner image on the intermediate transfer drum (21) is secondarily transferred to a recording medium (100), characterized in that the apparatus comprises an intermediate transfer drum shifting device (40, 70) for shifting the intermediate transfer drum (21), during the primary transfer, into a first state wherein the intermediate transfer drum (21) is brought into press-contact with the photosensitive drum (11), and, during the secondary transfer, into a second state wherein the intermediate transfer drum (21) is brought into press-contact with the recording medium (100) but not brought into press-contact with the photosensitive drum (11).

8 Claims, 14 Drawing Sheets

RECORDING APPARATUS HAVING A TRANSFER DRUM SHIFTING DEVICE

BACKGROUND OF THE INVENTION

1. Field of the Invention

The present invention relates to a recording apparatus which includes rotary members such as a photosensitive drum, as an image carrier, or an intermediate transfer drum.

2. Description of the Related Art

For example, in a full color printer of the electrophotographic type, multicolor toner images are primarily transferred in a sequential manner from the photosensitive drum to the intermediate transfer drum to overlay the respective color images thereon so that a full color image is formed, which is then secondarily transferred onto the recording medium.

In the recording apparatus wherein the above intermediate transfer drum is used, if the distance between the photosensitive drum and the intermediate transfer drum is fixed, a problem occurs in that a difference of color shade may be generated in the primary transfer image by a significant variation in the contacting force within one rotation of both the drums due to a shape error in the intermediate transfer drum (such as eccentricity or a diametric error).

Accordingly, in the prior art, the recording apparatus is adapted so that the axial position of the intermediate transfer drum is movable and the drums are brought into contact under a constant contacting force via a spring or the like.

The secondary transfer of a toner image from the intermediate transfer drum to the recording medium is carried out by press-contacting the recording medium onto the intermediate transfer drum by a transfer roller disposed on the back side of the recording medium in a secondary transfer zone.

The position of intermediate transfer drum, however, inevitably fluctuates due to shape errors (such as eccentricity or deviation from the circularity) during the secondary transfer process, which causes a variation in the contacting force between the intermediate transfer drum and the recording medium and generates an uneven secondary transfer to deteriorate the image quality on the recording medium.

SUMMARY OF THE INVENTION

The primary object of the present invention is to provide a reasonable and economical recording apparatus wherein the inevitable fluctuation of a rotary member such as an intermediate transfer member or the like has no adverse influence upon other elements of the apparatus.

According to a first aspect of the present invention, there is provided a recording apparatus wherein a toner image on an image carrier is primarily transferred to an intermediate transfer drum and the toner image on the intermediate transfer drum is secondarily transferred to a recording medium characterized in that the apparatus comprises an intermediate transfer drum shifting device for shifting the intermediate transfer drum, during the primary transfer, into a first state wherein the intermediate transfer drum is brought into press-contact with the image carrier, and, during the secondary transfer, into a second state wherein the intermediate transfer drum is brought into press-contact with the recording medium but not brought into press-contact with the image carrier.

According to a second aspect of the present invention, there is provided a recording apparatus wherein a toner image on an image carrier is primarily transferred to an intermediate transfer drum and the toner image on the intermediate transfer drum is secondarily transferred to a recording medium, characterized in that the apparatus comprises an intermediate transfer drum shifting device for shifting the rotatable intermediate transfer drum, during the primary transfer, into a first state wherein the intermediate transfer drum is brought into press-contact with the image carrier but not brought into press-contact with the recording medium, and, during the secondary transfer, into a second state wherein the intermediate transfer drum is brought into press-contact with the recording medium, and a transfer roller arranged on the side opposite to the intermediate transfer drum, for nipping the recording medium during the secondary transfer with a predetermined pressure in association with the intermediate transfer drum, the transfer roller being built into the intermediate transfer drum shifting device so that the relative positional relationship between the transfer roller and the intermediate transfer drum is constantly maintained.

According to a third aspect of the present invention, there is provided a recording apparatus comprising rotary members such as an image carrier or an intermediate transfer drum, and a cleaner device for removing a toner from the intermediate transfer drum, characterized in that the cleaner device comprises a cleaner blade movable close to and apart from the rotary members, a waste toner receptacle for receiving a waste toner removed from the rotary members by the cleaner blade, and a waste toner conveying device disposed in the waste toner receptacle for conveying the waste toner to a predetermined position, wherein the attaching/detaching operation of the cleaner blade is carried with a rotary motion which has its center generally at the waste toner conveying device.

According to a fourth aspect of the present invention, there is provided a recording apparatus wherein a toner image on an image carrier is primarily transferred to an intermediate transfer drum and the toner image on the intermediate transfer drum is secondarily transferred to a recording medium, comprising a cleaner device for removing toner from the intermediate transfer drum, characterized in that the cleaner device comprises a cleaner blade movable close to and apart from the intermediate transfer drum, a waste toner receptacle for receiving a waste toner removed from the rotary members by the cleaner blade, and a waste toner conveying device disposed in the waste toner receptacle for conveying the waste toner to a predetermined position, wherein the attaching/detaching operation of the cleaner blade is carried out with rotary motion which has its center generally at the waste toner conveying device.

In the first aspect of the present invention, the intermediate transfer drum is shifted by the intermediate transfer drum shifting device, while corresponding to the primary transfer and the secondary transfer, so that in the first state, suitable for the primary transfer, the intermediate transfer drum is brought into press-contact with the image carrier but not with the recording medium and in the second state, suitable for the secondary transfer, the intermediate transfer drum is brought into press-contact with the recording medium but not with the image carrier.

In the second aspect of the present invention, the transfer roller is built into the intermediate transfer drum shifting device to stably maintain the relative positional relationship between the transfer roller and the intermediate transfer drum at a constant state.

In the third and fourth aspects of the present invention, the cleaner blade makes a rotary motion, with its center generally at the waste toner conveying device, to be movable close to and away from the intermediate transfer drum.

BRIEF DESCRIPTION OF THE DRAWINGS

These and other objects of the present invention will become apparent from the following detailed description of the preferred embodiment of the invention, taken in connection with the accompanying drawings.

In the drawings.

DESCRIPTION OF THE PREFERRED EMBODIMENTS

Figure 1:
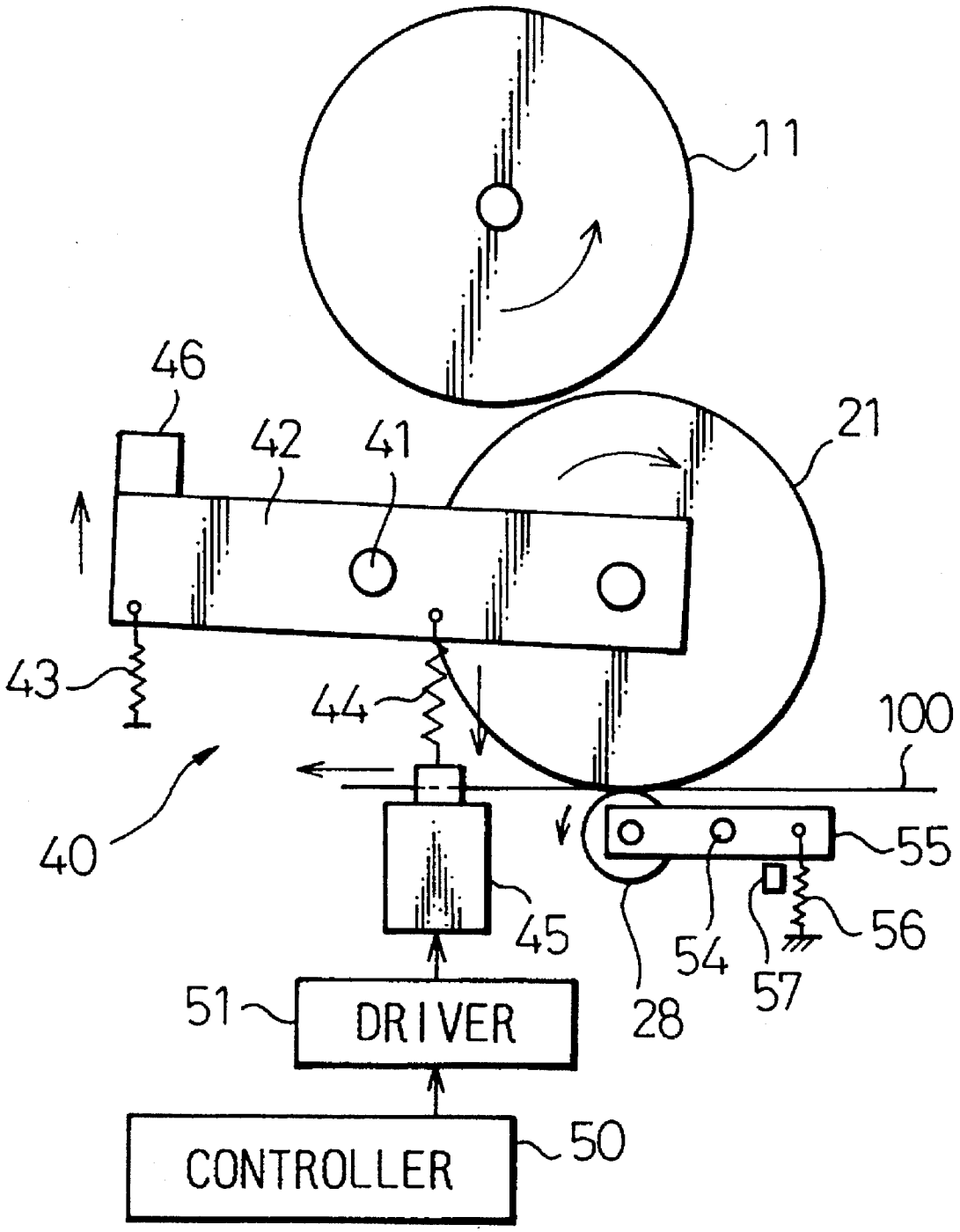
FIG. 1 is a schematic view of a main part of a first embodiment.

A plurality of embodiments of the present invention will be described with reference to the drawings wherein common parts or elements are denoted by the same reference numerals throughout the drawings and only characteristic features are explained while properly eliminating the explanation common thereto.

Figure 3:
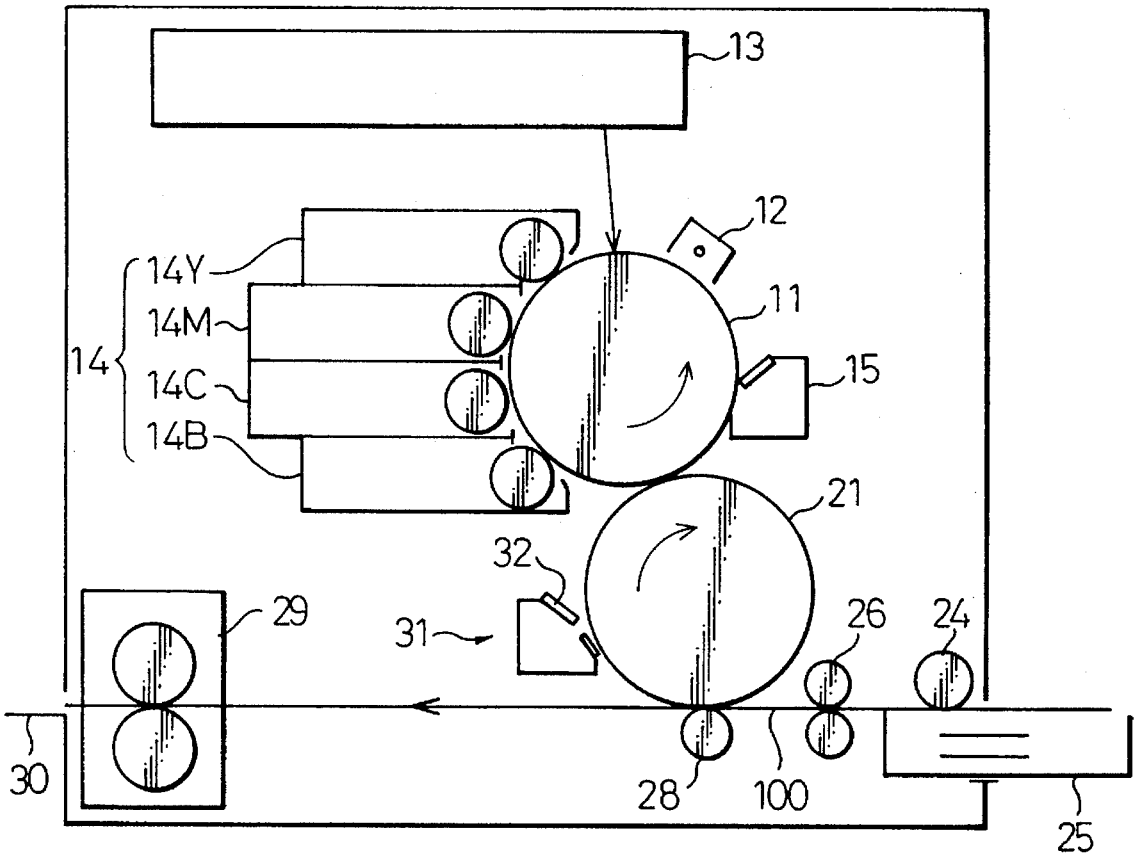
FIG. 3 is an overall schematic view of the first embodiment.
Figure 4:
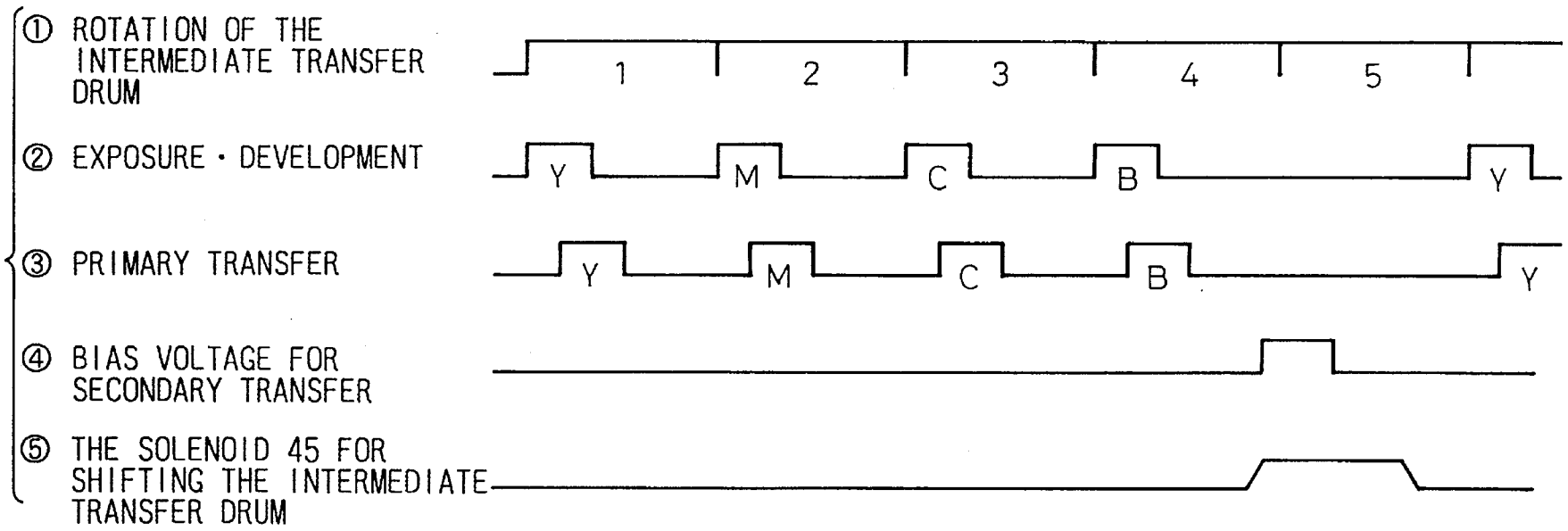
FIG. 4 is a time chart of one example of the operation of the first embodiment.

FIG. 3 illustrates a full color printer according to a first embodiment of the present invention, which is controlled, as shown in a time chart of FIG. 4, by a controller not shown in FIG. 3.

On the periphery of a photosensitive drum 11 (image carrier) are arranged a charger 12, an exposing unit 13, a developer 14 and a cleaner 15. A photosensitive drum 11 is rotated at a constant speed in the arrowed direction. After the surface of the photosensitive drum 11 is charged by the charger 12, an electrostatic latent image is formed on the surface of the photosensitive drum 11 by the exposing unit 13 at each rotation.

The developer 14 consists of four color developers; a yellow toner developer 14Y, a magenta toner developer 14M, a cyan toner developer 14C and a black toner developer 14B; so that single color toner images are formed one by one on the photosensitive drum 11 in the above order at each rotation of the photosensitive drum 11 (see FIG. 4 ①, ②).

An intermediate transfer drum 21 has the same diameter as the photosensitive drum 11 so that it makes one rotation, while being pressed onto the photosensitive drum 11 at a predetermined contacting force, as the photosensitive drum 11 rotates once, in the same direction and at the same peripheral speed as the photosensitive drum 11. Between the intermediate transfer drum 21 and the photosensitive drum 11 is applied a predetermined bias voltage.

As a result, the toner image on the photosensitive drum 11 is transferred to the intermediate transfer drum 21 (primary transfer); i.e., four single color toner images are transferred to the intermediate transfer drum 21 one by one as the photosensitive drum 11 makes four rotations and overlap each other to finally form a full color toner image on the intermediate transfer drum 21 (see FIG. 4 ③).

Toner left on the photosensitive drum 11, and not transferred therefrom to the intermediate transfer drum 11, is cleaned off, after the four single color toner images are transferred, by the cleaner 15.

A recording paper 100 (recording medium) is held, after being taken out from a paper cassette 25 by a pickup roller 24, at the nip of resist rollers 26 so that the supply of the recording paper is timed with the electrophotographic process. Thereafter, the recording paper 100 is moved into the gap between a transfer roller 28 used for the secondary transfer and the intermediate transfer drum 21.

The transfer roller 28 is located on the back side of the recording paper 100 in the secondary transfer zone. The transfer roller 28 is away from the intermediate transfer drum 21 during the primary transfer process. Accordingly, the recording paper 100 is not brought into press-contact with the intermediate transfer drum 21.

However, if all of the four single color toner images have been transferred, the intermediate transfer drum 21 is shifted to be away from the photosensitive drum 11 and close to the transfer roller 28 and comes into press-contact with the recording medium 100. In association therewith, a bias voltage is applied between the transfer roller 28 and the intermediate transfer drum 21 (see FIG. 4 ④).

As a result, the full color toner image formed of the overlapped four single color toners is transferred from the intermediate transfer drum 21 to the recording paper 100 (secondary transfer). The recording paper 100 is supplied to a fixing unit 29, and after the full color toner image is thermally fixed on the recording medium 100, the recording paper 100 is discharged to a stacker 30 outside the printer.

When the secondary transfer to the recording paper 100 has been completed, the transfer roller 28 moves away from the intermediate transfer drum 21 and is brought into contact with the photosensitive drum 1. Also, a blade of a cleaner 31 is brought into press-contact with the intermediate transfer drum 21 to clean the same after the secondary transfer has been completed. After the completion of cleaning, the cleaner 31 moves away from the intermediate transfer drum 21.

By repeating the above steps, full-color recordings are sequentially carried out on fresh recording papers 100.

Figure 2:
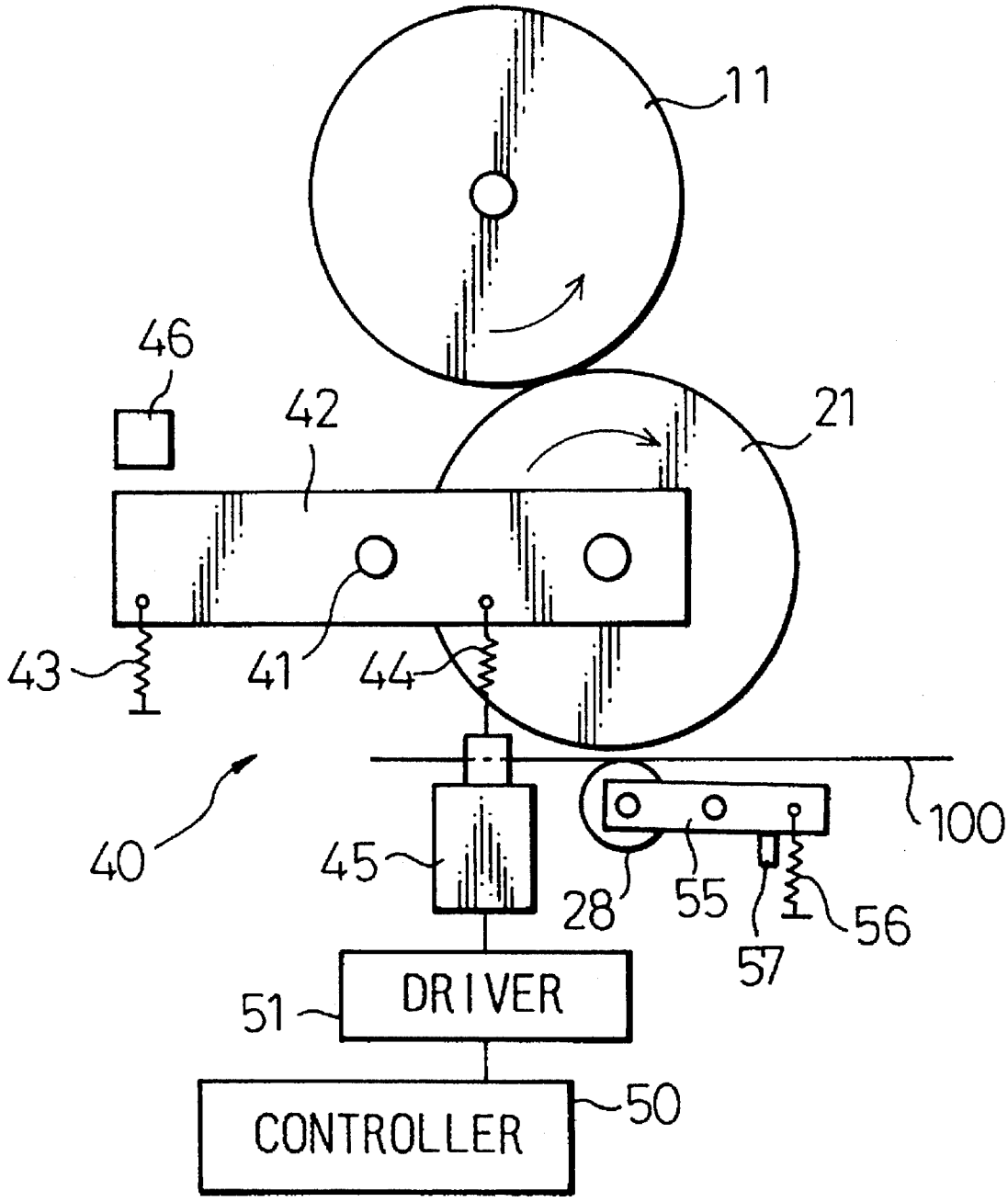
FIG. 2 is a schematic view illustrating one aspect of the operation of the first embodiment.

FIGS. 1 and 2 illustrate an intermediate transfer drum shifting device 40 (41 through 46) for shifting the intermediate transfer drum 21.

The intermediate transfer drum 21 is pivoted on a supporting plate 42 rotatably held on an axis 41, and is located at a first position during the primary transfer process as shown in FIG. 2 and brought into press-contact with the photosensitive drum 11 with a predetermined contacting force due to a stretching coil spring 43. Accordingly, even if there were any dimensional errors in the parts constituting the drums 11 and 21, a uniform primary transfer could be always guaranteed, under the constant contacting force, due to the stretching coil spring 43.

The supporting plate 42 is coupled to a solenoid 45 via a coil spring 44 which is slackened when the solenoid 45 is switched off (in the non-attractive state) so that no spring force acts on the supporting plate 42.

However, if the solenoid 45 is switched on (in the attractive state), the supporting plate 42 is pulled, via the coil spring 44, to rotate around the axis 41, whereby the intermediate transfer drum 21 is moved away from the photosensitive drum 11.

As a result, as shown in FIG. 1, the intermediate transfer drum 21 moves to a second position wherein the supporting plate 42 abuts a stop 46, and is stationary at that position.

Such operational controls of the apparatus are carried out by a controller 50 associated with other operations within the apparatus, so that a control signal is timely issued to a driver 51 for the solenoid 45. Such a timing is illustrated in FIG. 4 ⑤, wherein the solenoid 45 is in the ON state while the secondary transfer bias is applied. Accordingly, the solenoid 45 is in the ON state during the secondary transfer to hold the intermediate transfer drum 21 in the second position away from the photosensitive drum 11.

In the second position, the intermediate transfer drum 21 is brought into press-contact with the transfer roller 28 used for the secondary transfer so that the recording paper 100 nipped therebetween is moved while being pressed onto the intermediate transfer drum 21.

The transfer roller 28 is rotatably supported by a supporting plate 55 pivoted on an axis 54, while being biased, by a stretching coil spring 56, in the direction towards the intermediate transfer drum 21.

As shown in FIG. 2, during the primary transfer in which the intermediate transfer drum 21 is brought into press-contact with the photosensitive drum 11, the supporting plate 55 abuts onto a stop 57 to stop the transfer roller 28 from being further displaced, whereby the intermediate transfer drum 21 is in the first state away from the transfer roller 28 and is not brought into press-contact with the recording paper 100.

However, as shown in FIG. 1, when the intermediate transfer drum 21 moves downward while being away from the photosensitive drum 11, the transfer roller 28 is pushed down by the intermediate transfer drum 21 whereby a predetermined transfer pressure is applied onto the recording paper 100 by a balance between the two coil springs 43 and 56.

As described above, according to the apparatus in the above embodiment, the exposure and development of one color are carried out when the intermediate transfer drum 21 makes one rotation to form a single color toner image on the photosensitive drum 11. The toner images thus formed are sequentially overlapped with each other on the intermediate transfer drum 21 during the primary transfer process so that a four-colored toner image is formed through four rotations of the intermediate transfer drum 21.

After the completion of the primary transfer process, the controller 50 issues an attraction command to the solenoid 45 to shift the intermediate transfer drum 21 from the first state in press-contact with the photosensitive drum 11 shown in FIG. 2 to the second state in press-contact with the transfer roller 28 shown in FIG. 1. Simultaneously therewith, the resist roller 26 starts to supply the paper so that the secondary transfer process is carried out to transfer the full color toner image on the intermediate transfer drum 21 to the recording paper 100.

During the secondary transfer process, since the intermediate transfer drum 21 is away from the photosensitive drum 11 so that the position of the intermediate transfer drum 21 relative to the transfer roller 28 is unchanged, the position at which the secondary transfer is conducted does not fluctuate. Also, since the contacting force onto the recording paper 100 does not fluctuate, a deterioration of image in the secondary transfer can be avoided.

The first state shown in FIG. 2 and the second state shown in FIG. 1 are alternately repeated in accordance with the timing of the primary and secondary transfers so that consecutive four rotations of the drums 11, 21 are in the first state and the one rotation succeeding thereto is in the second state.

As a solenoid 45, it is possible to use a self-holding type instead of a normal type wherein the attractive force is generated when the current is supplied. In such a case, the power consumption of the apparatus can be saved because the retention force is maintained even though the power is interrupted while the attractive state continues.

Figure 5:
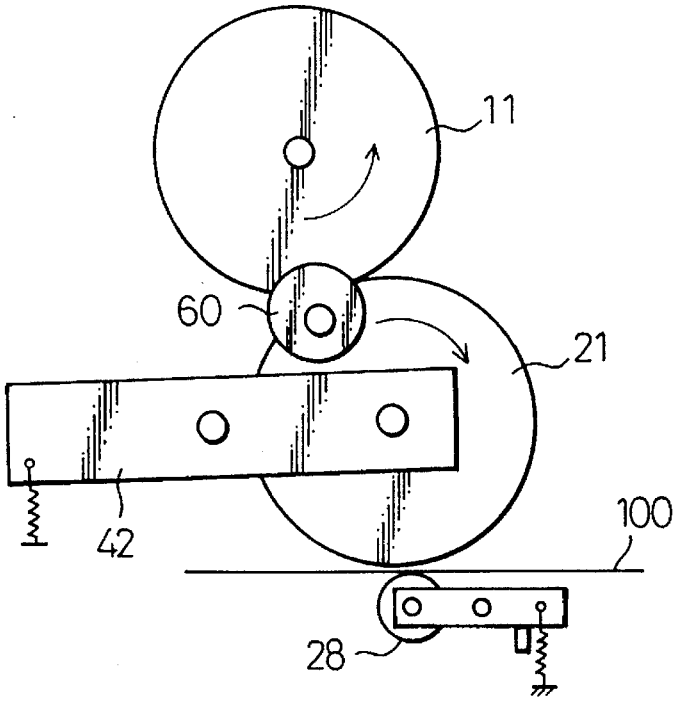
FIG. 5 is a schematic view of a main part of a second embodiment.
Figure 6:
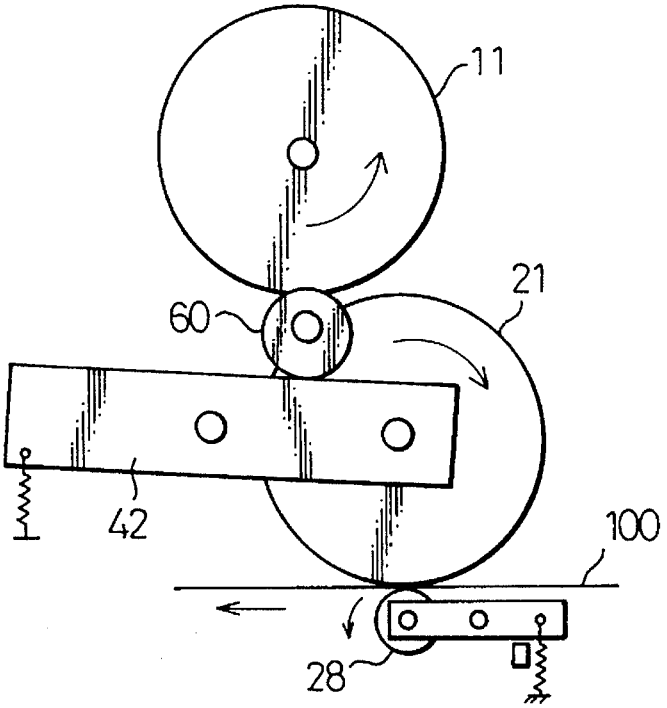
FIG. 6 is a schematic view illustrating one aspect of the operation of the second embodiment.
Figure 7:
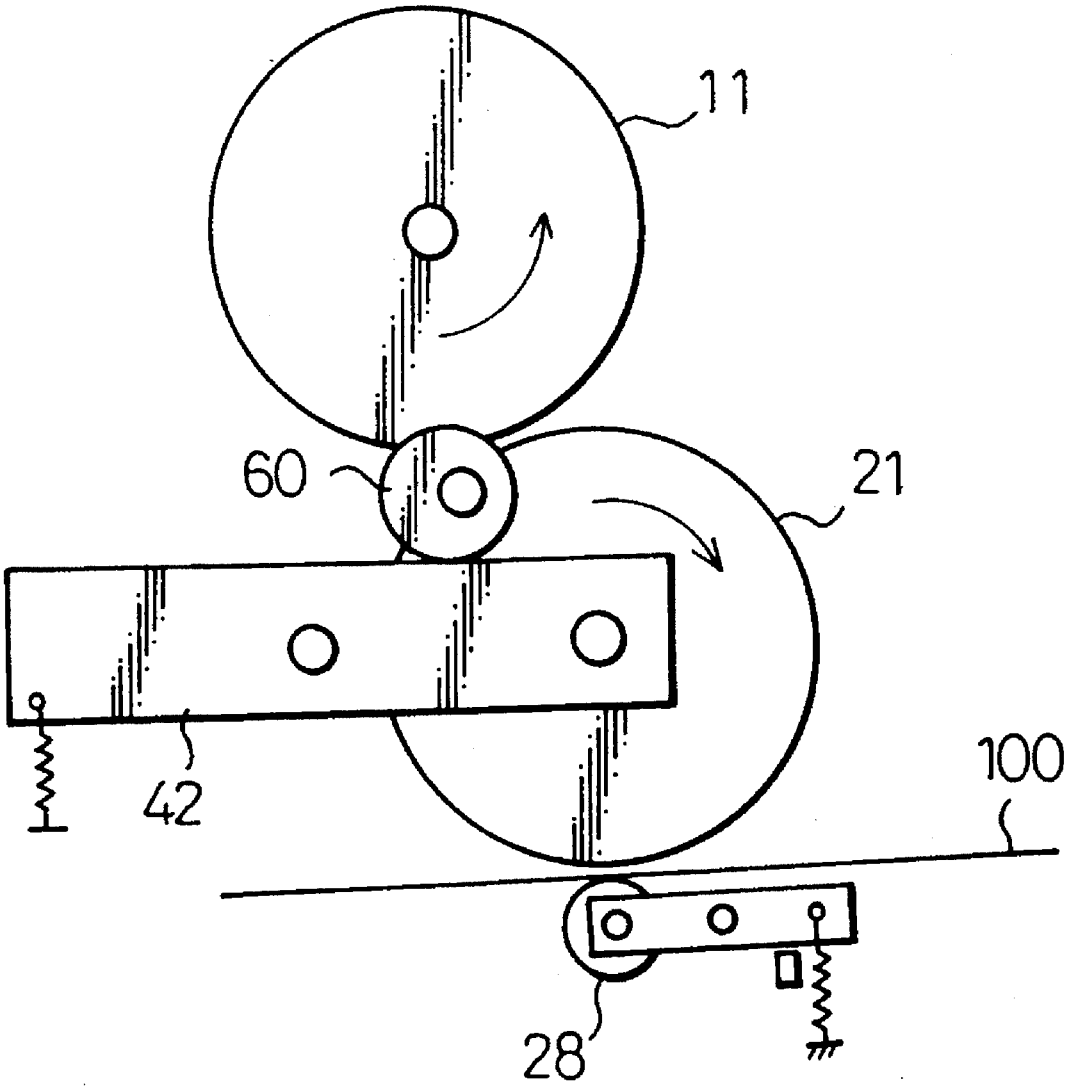
FIG. 7 is a schematic view illustrating another aspect of the operation of the second embodiment.

FIGS. 5, 6 and 7 illustrate a second embodiment of the present invention wherein an eccentric cam 60 is used instead of the solenoid 45 and the stop 46, for carrying out the same operation as the first embodiment.

FIG. 5 shows a first state in which the eccentric cam 60 occupies an angular position not abutting the supporting plate 42 of the intermediate transfer drum 21. FIG. 6 shows a second state in which the eccentric cam 60 occupies another angular position abutting to the supporting plate 42 of the intermediate transfer drum 21 so that the intermediate transfer drum 21 is away from the photosensitive drum 11 and pushed toward the transfer roller 28.

In this embodiment, as shown in FIG. 7, the intermediate transfer drum 21 can be maintained in a third position in which the intermediate transfer drum 21 is away from both of the photosensitive drum 11 and the transfer roller 28, by holding the eccentric cam 60 in an intermediate state between the first and second states. Thereby, it is possible to prevent the generation of the deformation of surface contour of the intermediate transfer drum 21, which may occur due to the press-contact of intermediate transfer drum 21 with the photosensitive drum 11 or the transfer roller 28 when the printing is not being carried out.

As stated above, in the first and second embodiments, not only the primary transfer is favorably carried out since the image carrier and the intermediate transfer drum are brought into press-contact with each other at a predetermined contacting force during the primary transfer process, but also the secondary transfer is smoothly carried out since no fluctuation occurs in the transfer position and the contacting force between the intermediate transfer drum and the recording medium during the secondary transfer process. Thus, an excellent recording quality, without a deterioration of the image, can be obtained.

Next, a third embodiment of the present invention will be described with reference to FIGS. 8 through 12. In an intermediate transfer drum shifting device 70 according to the third embodiment, the transfer roller 28 is not provided on the stationary body of the printer unlike the first and second embodiments, but is rotatably held by a pair of arm plates 73 which, in turn, is pivoted to a pair of supporting plates 71 for rotatably holding the intermediate transfer drum 21 on the opposite sides thereof. The arm plate 73 is rotatable around an axis 76.

Figure 8:
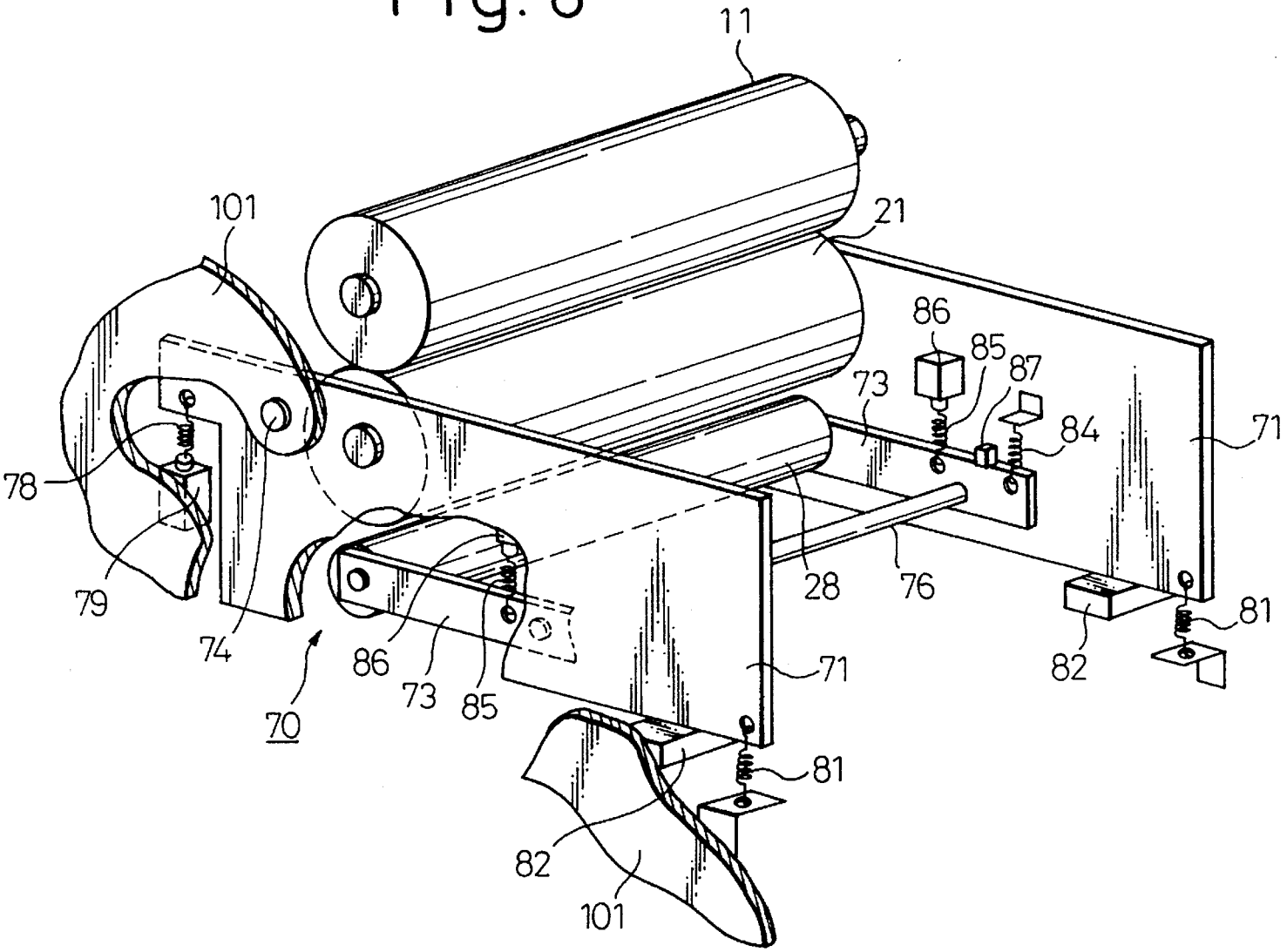
FIG. 8 is a perspective view of a main part of a third embodiment.
Figure 9:
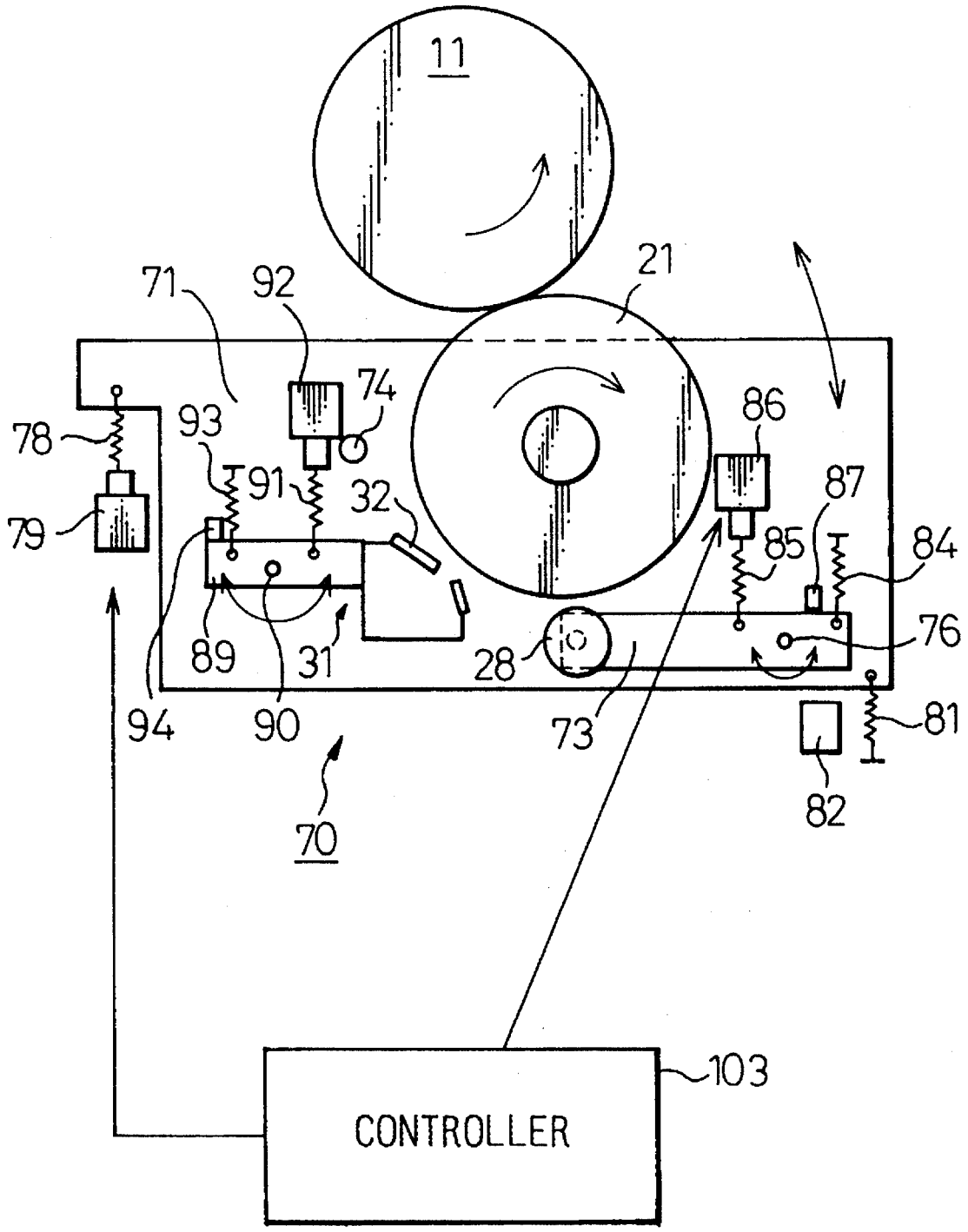
FIG. 9 is a side view of the main part of the third embodiment.
Figure 10:
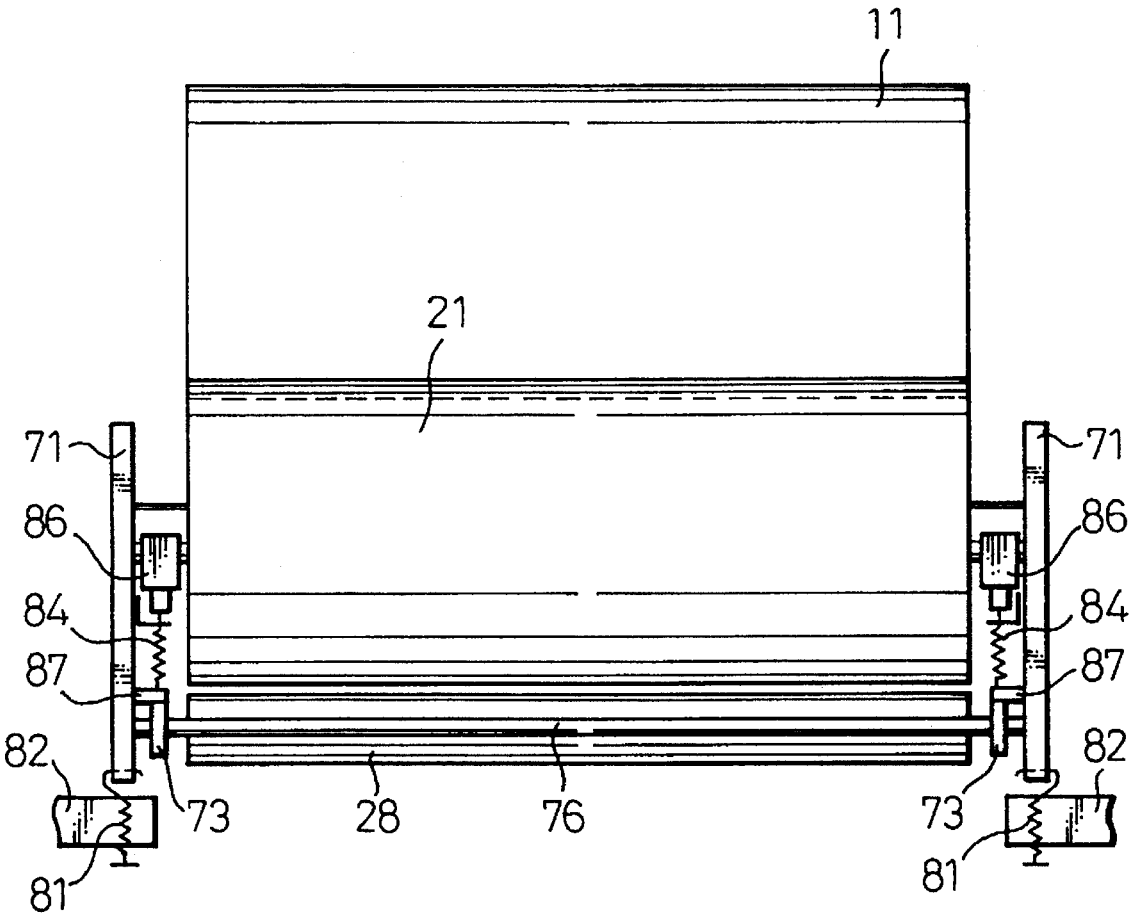
FIG. 10 is a front view of the third embodiment.

The supporting plate 71 is rotatable around an axis 74 relative to a printer body 101 (FIG. 8). One side of the supporting plate 71 is connected to a solenoid 79 attached to the printer body 101 via a spring 78 and the other side is connected to the printer body 101 via a return spring 81, while the axis 74 is arranged therebetween. When the solenoid 79 is switched on (to generate the attraction force), the supporting plate 71 is rotated, via the spring 78, to bring the intermediate transfer drum 21 into press-contact with the photosensitive drum 11 at a predetermined pressure. When the solenoid 79 is switched off (to eliminate the attraction force), the spring 78 is slackened to prevent the spring force from acting, whereby the supporting plate 71 is rotated by the action of the return spring 81 to a position abutting a stop 82. Thus the intermediate transfer drum 21 is detached from the photosensitive drum 11.

The arm plate 73 is provided on the supporting plate 71 and has the transfer roller 28 at a tip end thereof. One side of the arm plate 73 is attached to the supporting plate 71 via a spring 84 and the other side is connected via a spring 85 to a solenoid 86 attached to the supporting plate 71, while the axis 76 is arranged therebetween. When the solenoid 86 is switched on (to generate the attraction force), the supporting plate 73 is rotated, via the spring 85, to bring the transfer roller 28 into press-contact with the intermediate transfer drum 21 at a predetermined pressure. When the solenoid 86 is switched off (to eliminate the attraction force), the spring 85 is slackened to prevent the spring force from acting, whereby the supporting plate 73 is rotated by the action of the return spring 84 to a position abutting a stop 87. Thus the transfer roller 28 is detached from the intermediate transfer drum 21. In this regard, the attractive actions of the solenoids 79 and 86 are separately controlled by a controller 103.

In the third embodiment, a cleaner blade 32 of a cleaner device 31 for removing waste toners left on the intermediate transfer drum is integrally provided at a tip end of a cleaner supporting plate 89 which, in turn, is provided on the supporting plate 71. The cleaner supporting plate 89 is rotatable on an axis 90. One side of the cleaner supporting plate 89 is connected to a solenoid 92 attached to the supporting plate 71 via a spring 91 and the other end is attached to the supporting plate 71 via a return spring 93, while putting the axis 90 therebetween. When the solenoid 92 is switched on (to generate the attraction force), the cleaner supporting plate 89 is rotated to bring the cleaner blade 32 closer to the intermediate transfer drum 21. When the solenoid 92 is switched off (to eliminate the attraction force), the spring 91 is slackened to prevent the spring force from acting whereby the cleaner supporting plate 89 is rotated by the action of the return spring 93 to a position abutting onto a stop 94. Thus the cleaner blade 32 is detached from the intermediate transfer drum 21. The timing of this motion of the intermediate transfer drum cleaner device 31 (cleaner blade 32) close to or apart from the intermediate transfer drum 21 generally coincides with that of the transfer roller 28.

Figure 11:
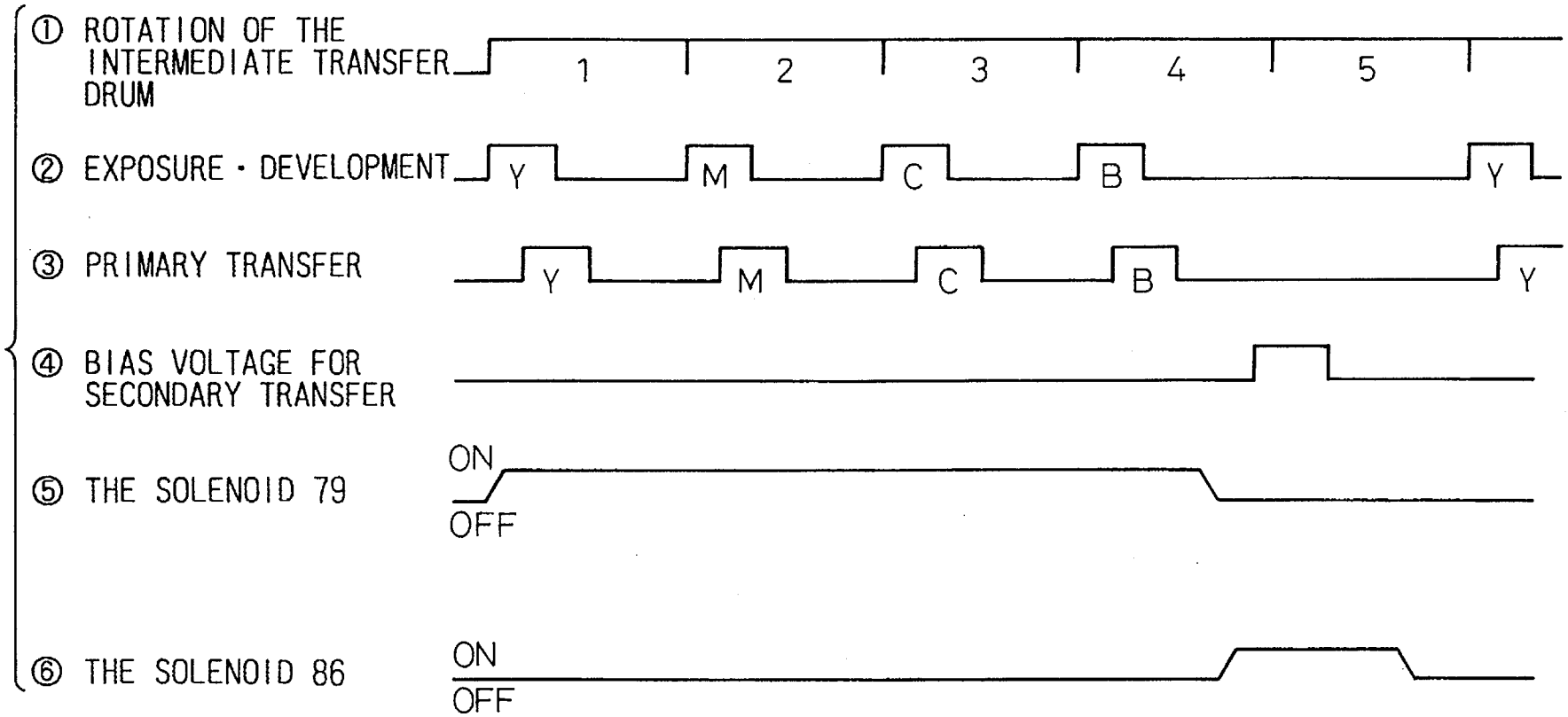
FIG. 11 is a time chart of one example of the operation of the third embodiment.
Figure 12:
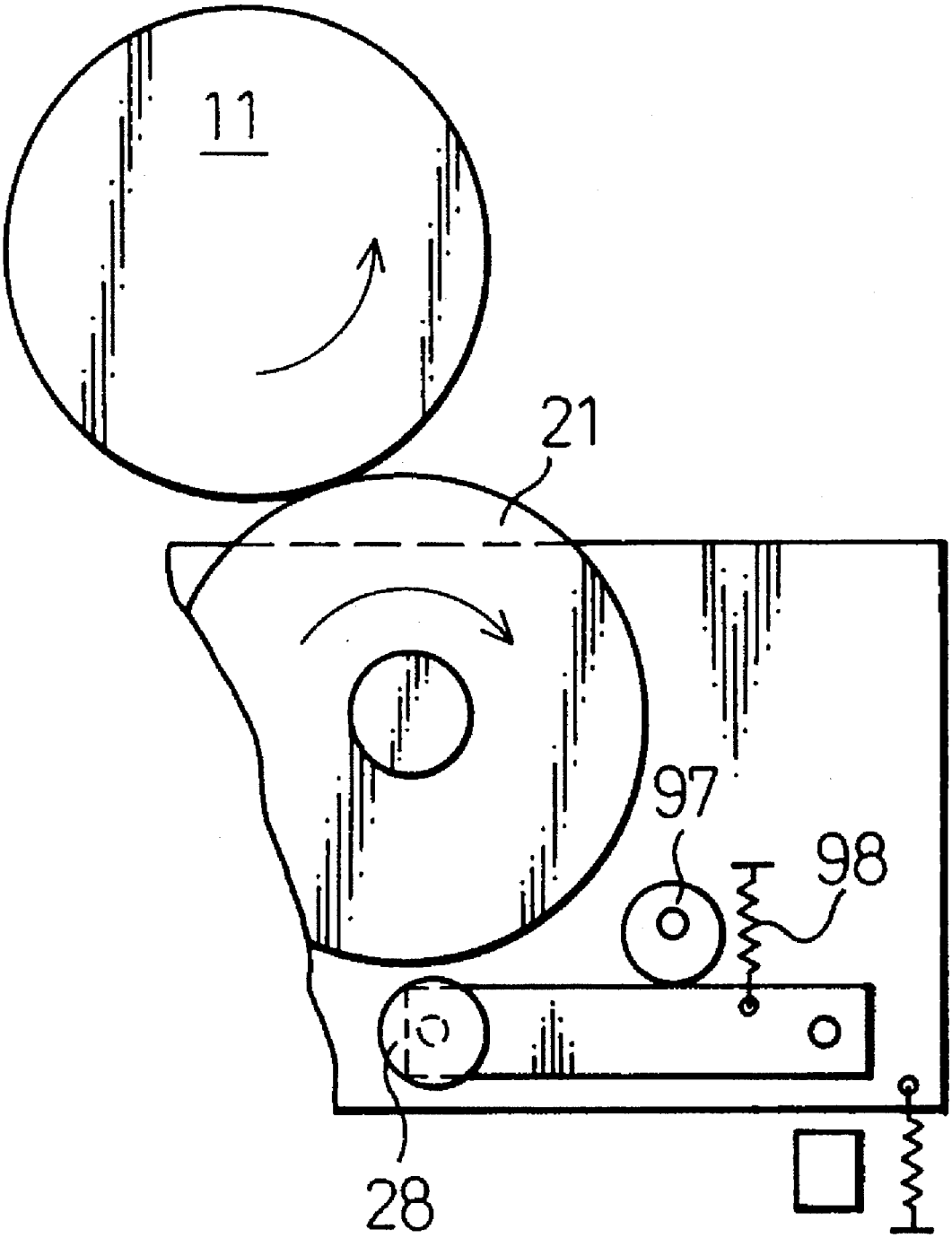
FIG. 12 is a schematic view illustrating another structure for moving the transfer roller close to and away from the drum.

One example of the operations of the third embodiment will be described below with reference to FIG. 11 (operation sequence). In the color printing operation, single color images are formed one by one on the photosensitive drum 11 through the exposure and development on the photosensitive drum 11 while the intermediate transfer drum 21 makes four rotations. The images formed on the photosensitive drum 11 overlap each other on the intermediate transfer drum 21 during the primary transfer process. Thus a four-color overlapped image is formed through four rotations of the intermediate transfer drum 21, during which the controller 103 issues the attraction commands to the solenoid 79 to bring the intermediate transfer drum 21 into press-contact with the photosensitive drum 11 at a predetermined pressure (see FIG. 9).

After the completion of the primary transfer process, the controller 103 issues the attraction command to the solenoid 86 to bring the transfer roller 28 into press-contact with the intermediate transfer drum 21. Then the recording paper is delivered from a waiting roller. Thus the secondary transfer process, for transferring the overlapped image on the intermediate transfer drum to the recording paper, is initiated. Since the press-contact between the intermediate transfer drum 21 and the photosensitive drum 11 continues during the secondary transfer process, the intermediate transfer drum 21 fluctuates as a whole about the axis 74 due to a shape error (such as eccentricity or deviation from the circularity) and/or assembly error. Since both of the intermediate transfer drum 21 and the transfer roller 28 are provided on the supporting plates 71 and modularized, the relative positional relationship is unchanged between the intermediate transfer drum 21 and the transfer roller 28, whereby the contacting position and/or the contacting force do not fluctuate. Accordingly, it is possible to effectively suppress the deterioration of transferred image (such as difference of color shade).

When a series of printing operations (transfer process) have been completed, the controller cancels the attraction command to the solenoid 79 to detach the intermediate transfer drum 21 from the photosensitive drum 11. Thereby, it is possible to eliminate the partial deformation or the like of the intermediate transfer drum 21 due to the vibration which may occur when both the drums are always brought into press-contact with each other. If such a deformation can be ignored, it is possible to substantially eliminate the solenoid 79 so that the intermediate transfer drum 21 and the photosensitive drum 11 are always brought into press-contact with each other.

As stated above, according to the third embodiment, since the intermediate transfer drum 21 and the transfer roller 28 are provided on the same supporting plates and modularized, it is possible to stably hold the relative positional relationship therebetween. In other words, while the intermediate transfer drum may fluctuate due to a shape error (such as eccentricity or deviation from the circularity), the positional relationship (contacting force) between the intermediate transfer drum and the transfer roller is stably maintained without disturbance from the fluctuation. Accordingly, it is possible to mitigate or eliminate such inconveniences as the difference of color shade (deterioration of image quality) in the transferred image during the secondary process.

Since the module of intermediate transfer drum and transfer roller can as a whole be away from the photosensitive drum, there is no inconvenience such as the vibration caused by the contact between the photosensitive drum and the intermediate transfer drum during the secondary transfer process.

Similarly, since the intermediate transfer drum cleaner device 31 is also provided on the same supporting plates to form a movable module, the positional relationship (contacting force) between the intermediate transfer drum and the cleaner device is stably and constantly maintained, whereby the cleaning capacity (waste toner removal ability) can be improved. Of course, instead of providing the intermediate transfer drum cleaner device 31 on the supporting plates 71, it is possible to provide the same on the printer body via a predetermined mechanism (not shown) for moving the device close to or apart from the intermediate transfer drum.

In this regard, as solenoids 79, 86 and 92, it is possible to use a self-holding type instead of a normal type wherein the attractive force is generated only when the current is supplied. In such a case, the power consumption of the apparatus can be reduced because the retention force is maintained even though the power is interrupted while the attractive state continues. While each of the mechanisms is structured by a solenoid, springs or stops in the third embodiment, it is possible to use a combination of an eccentric cam 97 and a spring 98, as partially shown in FIG. 12, to move the transfer roller 28 close to or away from the intermediate transfer drum 21. The third embodiment was explained as the application of the present invention to a color recording apparatus. However, the technical idea of the third embodiment is also applicable to a monochrome recording apparatus. In the latter case, of course, the mechanism for moving the transfer roller 28 and the intermediate transfer drum cleaner device 31 can be eliminated.

Figure 13:
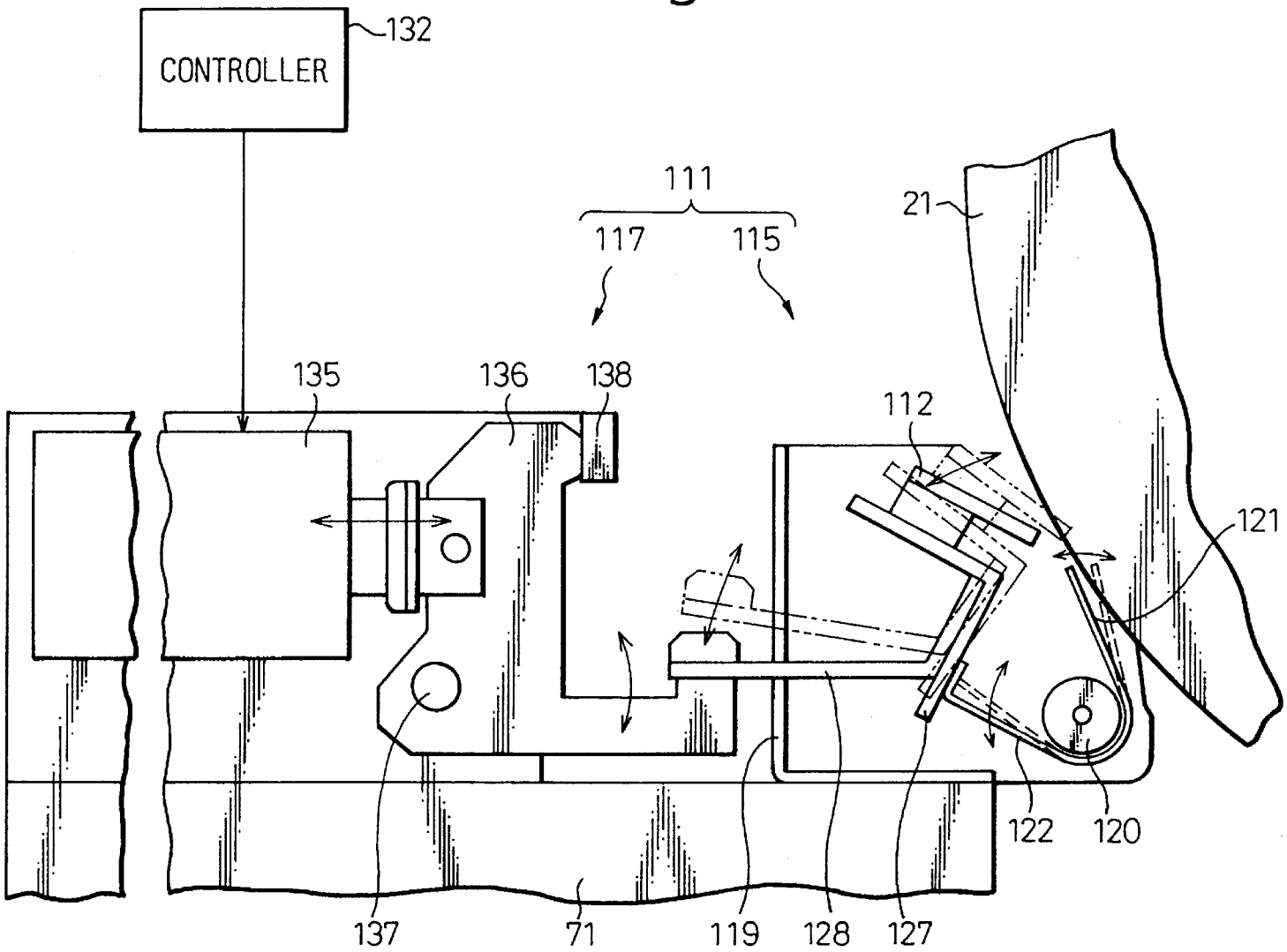
FIG. 13 is a side view of a main part of a modified intermediate transfer drum cleaner device.
Figure 14:
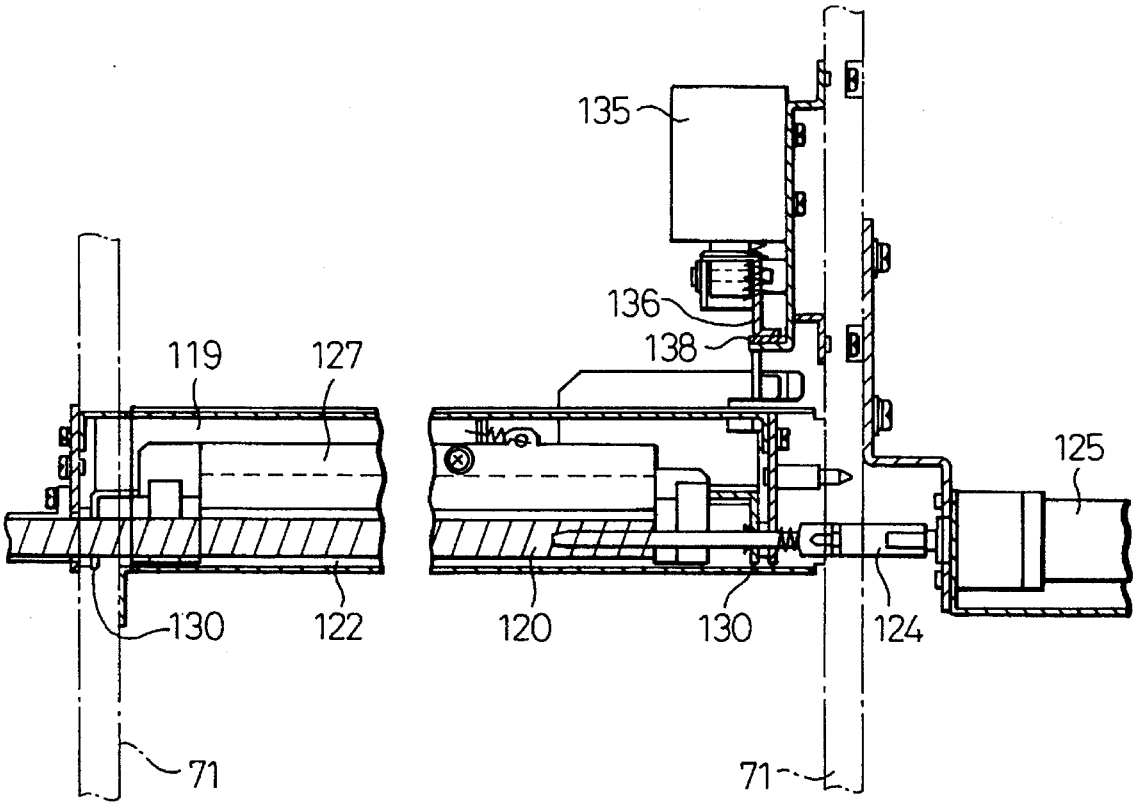
FIG. 14 is a front view of the modification shown in FIG. 13.
Figure 15:
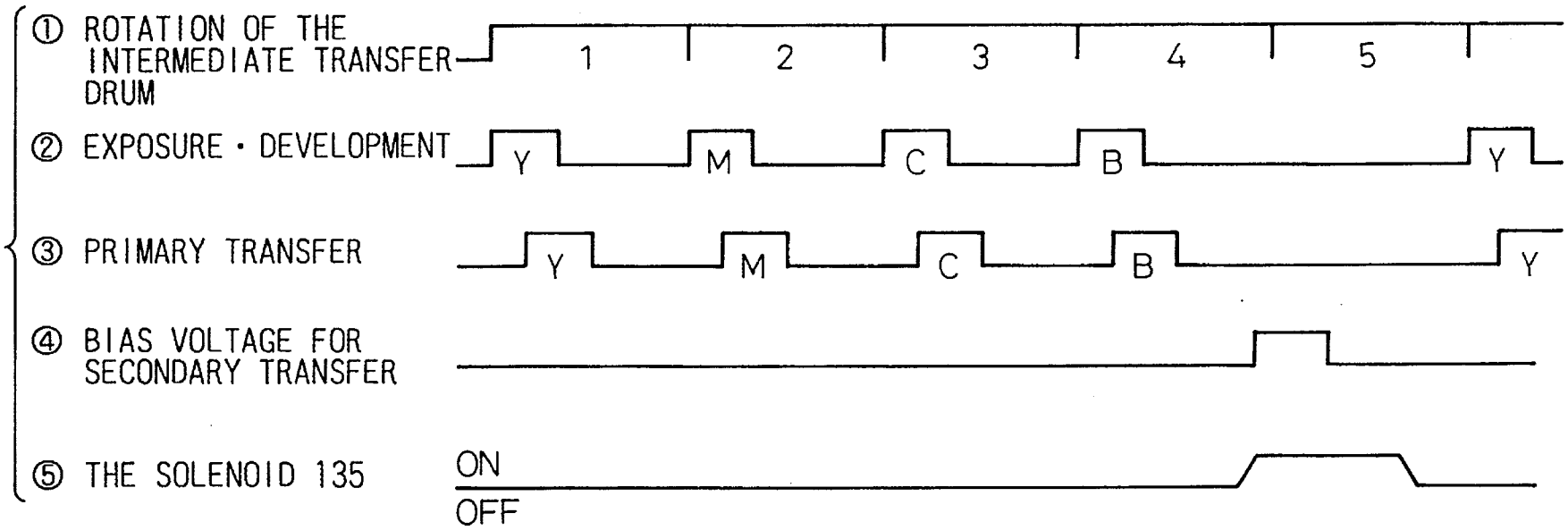
FIG. 15 is a time chart of one example of the operation of the modification shown in FIG. 13.

Finally, a modified intermediate transfer drum cleaner device will be briefly explained with reference to FIGS. 13 through 15.

The intermediate transfer drum cleaner device 111 is provided on the supporting plates 71, and includes a body section 115 having a cleaner blade 112 and a driving section 117 for moving the body section 115 close to or away from the intermediate transfer drum 21. In this regard, the cleaner device may alternatively be mounted on the printer body.

The body section 115 includes a frame 119 attached to the supporting plates 71, a screw member 120 for conveying waste toner rotatably held on the frame 119 and a waste toner receptacle 122 on which a thin rubber member 121 is adhered for preventing the escape of the toner. The screw member 120 is connected to a motor 125 via a coupling member 124 and conveys the waste toner (not shown) scraped off from the intermediate transfer drum 21 into the waste toner receptacle 122 by the cleaner blade 112 to a waste toner depot (not shown). A bracket 127 is secured to the waste toner receptacle 122, to which bracket a lever 128 and the cleaner blade 112 are fixed. The waste toner receptacle 122, the bracket 127, the lever 128 and the cleaner blade 112 are integrally rotatable around an axis of the screw member 120 via bearings 130 provided on the opposite sides thereof, and usually biased in the direction away from the intermediate transfer drum 21 by a spring (not shown).

The driving section 117 of the cleaner device 111 includes a solenoid 135 generating an attraction force in accordance with a command from a controller 132 for controlling the driving section and an L-shape member 136 connected with the solenoid 135. The L-shaped member 136 is rotatable around an axis 137 and usually biased on one side thereof by a return spring (not shown) to abut a stop 138. The other side thereof is associated with the lever 128 to push the same upward.

When the solenoid 135 is in the attractive phase, the L-shaped member 136 is rotated to push up the lever 128 against a force of a spring (not shown) to abut the cleaner blade 112 and the thin rubber member 121 onto the intermediate transfer drum 21. When the solenoid 135 is in the non-attractive phase, the L-shaped member 136 returns to abut the stop 138 by the action of a return spring (not shown) and the force for pushing up the lever 128 disappears. Thereby the cleaner blade 112 and the thin rubber member 121 are rotated to be away from the intermediate transfer drum 21. The motion of the cleaner device 111 based on the operation of the solenoid 135 is carried out during the secondary transfer process, for example, in accordance with a timing shown in FIG. 15. That is, the cleaner blade 112 and the thin rubber member 121 are brought into press-contact with the intermediate transfer drum 21 generally simultaneously with the transfer roller (not shown), and after the toner left on the intermediate transfer drum 21 during the secondary transfer process has been cleaned off, the cleaner blade 112 and the thin rubber member 121 are detached from the intermediate transfer drum 21.

As described above, in the illustrated modification of the cleaner device, since the motion thereof close to and away from the intermediate transfer drum is carried out by a rotary motion generally on the axis of the screw member for conveying the waste toner, it is possible to simplify the mounting structure of the motor as a source for driving the screw member to save the manufacturing cost. That is, according to the conventional structure wherein an axis of the rotary motion close to and away from the intermediate transfer roller does not coincide with the axis of the screw member, the screw member necessarily moves as a whole in accordance with the rotary motion, resulting in the complication (cost elevation) of the power transmission mechanism and the mounting structure of the motor. On the other hand, according to this modification, it is possible to avoid such inconveniences. Since the screw member can be arranged in the vicinity of the intermediate transfer drum, it is possible to considerably miniaturize a size of the waste toner receptacle.

While the above solenoid 135 is of a usual type which operates only when the current is supplied, it is possible to alternatively use a self-holding type solenoid (not shown) to save the power consumption. Also, instead of these solenoids, springs or the like, an eccentric cam (not shown) may be used. Further, the technical idea of the above modified embodiment is applicable not only to an intermediate transfer drum but also to an intermediate transfer belt or a photosensitive body. While a printer body is a color recording apparatus in the above modified embodiment, the same idea is applicable to a monochrome recording apparatus wherein a cleaner device moves close to and away from a drum.

As stated above, according to the present invention, the drawbacks in the prior art can be easily and effectively solved, and highly reliable and stable recording apparatus, that can be easily manufactured at less cost, is obtainable.

It is to be understood that the invention is by no means limited to the specific embodiments illustrated and described herein, and that various modifications thereof may be made which come within the scope of the present invention as defined in the appended claims.

I claim:

1. A recording apparatus, comprising:

an intermediate transfer drum;

an image carrier, wherein a toner image on the image carrier is primarily transferred to the intermediate transfer drum and the toner image on the intermediate transfer drum is secondarily transferred to a recording medium;

an intermediate transfer drum shifting device for shifting the intermediate transfer drum, during the primary transfer, into a first state wherein the intermediate transfer drum is brought into press-contact with the image carrier and is brought away from press-contact with the recording medium, and, during the secondary transfer, into a second state wherein the intermediate transfer drum is brought into press-contact with the recording medium and is brought away from press-contact with the image carrier.

2. A recording apparatus as defined by claim 1, further comprising a transfer roller arranged on the side opposite to the intermediate transfer drum, for nipping the recording medium during the secondary transfer with a predetermined pressure in association with the intermediate transfer drum.

3. A recording apparatus as defined by claim 1, wherein the intermediate transfer drum shifting device comprises a solenoid as a driving source thereof.

4. A recording apparatus as defined by claim 1, wherein the intermediate transfer drum shifting device comprises an eccentric cam mechanism for shifting the intermediate transfer drum.

5. A recording apparatus as defined by claim 1, further comprising means for retaining the intermediate transfer drum in a third state wherein the intermediate transfer drum is brought away from press-contact with either of the image carrier or the recording medium.

6. A recording apparatus, comprising:

an intermediate transfer drum;

an image carrier, wherein a toner image on the image carrier is primarily transferred to the intermediate transfer drum and the toner image on the intermediate transfer drum is secondarily transferred to a recording medium;

an intermediate transfer drum shifting device for shifting the rotatable intermediate transfer drum, during the primary transfer, into a first state wherein the intermediate transfer drum is brought into press-contact with the image carrier and is brought away from press-contact with the recording medium, and, during the secondary transfer, into a second state wherein the intermediate transfer drum is brought into press-contact with the recording medium and is brought away from press-contact with the image carrier; and a transfer roller arranged on the side opposite to the intermediate transfer drum, for nipping the recording medium during the secondary transfer with a predetermined pressure in association with the intermediate transfer drum, wherein the transfer roller is provided into the intermediate transfer drum shifting device so that the relative positional relationship between the transfer roller and the intermediate transfer drum is constantly maintained.

7. A recording apparatus as defined by claim 6, wherein the transfer roller is held so that it is held so that it is movable close to and away from the intermediate transfer drum.

8. A recording apparatus as defined by claim 6, wherein the intermediate transfer drum shifting device comprises a cleaner device for removing toner from the intermediate transfer drum, the cleaner device being movable close to or away from the intermediate transfer drum.

* * * * *